United States Patent [19]

Schleimann-Jensen

[11] 4,437,845

[45] * Mar. 20, 1984

[54] METHOD FOR MANUFACTURING A GAS-FILLED DISCHARGE TUBE FOR USE AS TRANSIENT PROTECTION

[75] Inventor: C. Arne Schleimann-Jensen, Stockholm, Sweden

[73] Assignee: TII Industries, Inc., Copiague, N.Y.

[ * ] Notice: The portion of the term of this patent subsequent to May 17, 2000 has been disclaimed.

[21] Appl. No.: 308,485

[22] Filed: Oct. 5, 1981

[51] Int. Cl.[3] ..... H01T 21/00

[52] U.S. Cl. ..... 445/39; 445/40; 445/54

[58] Field of Search ..... 228/219, 220; 445/54, 445/39, 40, 42, 43

[56] References Cited

U.S. PATENT DOCUMENTS 3,576,066 4/1971 Steward ..... 445/40

4,383,723 5/1983 Schleimann-Jensen ..... 445/54

FOREIGN PATENT DOCUMENTS 375201 6/1975 Sweden ..... 445/40

*Primary Examiner*—Nicholas P. Godici

*Assistant Examiner*—Kurt Rowan

*Attorney, Agent, or Firm*—Leonard W. Suroff

[57] ABSTRACT

A method for manufacturing a gas-filled discharge tube, designed, e.g., as transient protector, containing tube components comprised of at least two electrodes and an insulating body holding the electrodes joined vacuum-tight, with the electrodes and the insulating body dimensioned and arranged in such a way that at least one discharge gap is present in the tube, is disclosed. The manufacturing process consists of sealing at a suitable temperature the components of the tube at substantially atmospheric pressure in a light gas mixed with another gas which, in view of the intended function of the tube, is desirable and heavier than the first-mentioned gas, and reducing the pressure exteriorally of the tube below atmospheric pressure, while simultaneously lowering the temperature to such extent that the heavy gas can only to an insignificant degree penetrate the tube walls through diffusion and/or effusion, and the enclosed light gas can diffuse and/or be effused through the walls such that, as a result of the pressure difference, it will exit through the walls of the tube, thus causing a reduction in the total gas pressure inside the tube.

6 Claims, 1 Drawing Figure

METHOD FOR MANUFACTURING A GAS-FILLED DISCHARGE TUBE FOR USE AS TRANSIENT PROTECTION

BACKGROUND OF THE INVENTION

The present invention relates to a gas-filled discharge tube for use as transient protector, with at least two electrodes separated by a discharge gap and an insulating body which is joined to the electrodes and, jointly with them, forms a discharge chamber. The sealing of the tube occurs at atmospheric pressure and a suitable temperature, in a mixture of a light and a heavy gas suitable for the purpose, after which this gas mixture is pumped out or any other such step is taken until the gas pressure around the tube drops below atmospheric pressure and is suitably reduced to the order of magnitude of 3 kPa or less, while at the same time the temperature is adjusted in such a manner that the light gas enclosed in the tube, through diffusion or effusion, because of the pressure difference between the inside of the tube and its surroundings, exits through the tube walls, whereas the heavy gases can diffuse through the tube walls to an insignificant extent only. The gas diffusion brings about a reduction in the total gas pressure inside the tube and the process is interrupted when the desired pressure drop is obtained.

Gas filled discharge tubes are extensively used as protection against transient voltages in electronic equipment of various kinds, e.g. telephone equipment, computers, and safety systems. Discharge tubes for this special purpose consist, as a rule, of at least two electrodes which, with a suitable spacing between them, are joined to an insulating body, so as to form at least a discharge gap in a discharge chamber that is vacuum-tight at normal temperatures and which encloses a gas of a suitable kind at a suitable pressure. The insulating body is, as a rule, made of ceramics. Two electrode tubes are used most often. The tube can be connected between conducting points which can be exposed to transient voltages, or between such a point and the ground. These electrode tubes are also being used. A central electrode, as a rule, is connected to the ground, whereas the outer electrodes are connected to the points to be protected.

The electrode material of the tube, the size of the electrode gap and the type and pressure of the gas will determine the starting or striking voltage of the tube. The latter must be adjusted in such a way that the tube will not ignite at the normally applied voltages. However, if voltages originate which could harm the equipment, the tube will ignite and cause the voltage to drop across the tube and thus across the protected equipment, thereby preventing the occurrence of damage.

Since the discharges occurring between the electrodes generate a displacement of materials between same, there is a certain risk of disturbances in the form, e.g., of short circuits in the electrode gap. For that reason, gaps between the electrodes are rarely very small. The gaps mostly used are of the order of magnitude of 0.4–0.5 mm. As a filler gas, argon is frequently used, possibly with an addition of about 10% of hydrogen. Sometimes krypton and xenon are used instead of argon. In connection with copper electrodes and an electrode gap of about 0.5 mm, a gas pressure is frequently selected with measures about 10 kPa at normal room temperature. This will result in a frequently desirable starting voltage of about 350 V. If, for any reason, it is desired to manufacture a tube for higher gas pressure, the electrode gap should be reduced accordingly, since the product of gap and pressure must not change if the starting voltage is to remain unchanged. As already stated above, gap disturbances can be a problem in such a case.

As mentioned before, an insulating body of ceramics, designed as hollow cylinder, is used most frequently. The tube is usually manufactured in such a way that the end surfaces of the ceramic unit are metalized, often by means of a coat of molybdenum-manganese and an overcoat of nickel. The electrodes can then be soldered to this metalized layer. If the electrodes are of copper, e.g. a silver-copper eutectic can be used as suitable soldering material at about 800° C. Other electrode material may require a different kind of soldering metals. As a rule, the soldering, together with the rest of the process, follows either one of the two methods described below.

In one case a ring of soldering material is placed on the portion of the electrode surface to be soldered to one metalized end surface of the ceramic tube. The ceramic tube is placed on the solder ring, while a new solder ring is placed on the other metalized end surface of the ceramic tube, and the second electrode is placed on that solder ring. This electrode has been provided with a traversing narrow copper tube, to form an open channel into the internal volume of the tube. The soldering is done most often in a belt furnace with reducing gas, usually hydrogen or a mixture of hydrogen and nitrogen. The temperature depends on the soldering material, with the silver-copper eutectic, this is, as mentioned, about 800° C. The soldering is followed by vacuum-pumping at about 400° C., and by a refilling or replenishing with the desired gas up to the desired pressure. Pumping and refilling are frequently performed manually. However, semi-automatic methods or devices are, occasionally, also used. Vacuum-pumping and refilling occur through the tube, the so-called pump out or exhaust tube, which one of the electrodes has been provided with. At times, a small portion of the refilling gas is replaced by tritium, a radioactive isotope of hydrogen, which has a certain stabilizing effect on the starting voltage of the tube. After vacuum-pumping and gas refilling have been completed, the copper tube is nipped off near the electrode. This nipping off, as a result of cold diffusion, will cause a vacuum-tight joint. The manufacturing process concludes with an electrical stabilizing treatment prior to the final test.

The second method calls for stacking of the tube parts in the same manner as above. However, in this case no exhaust tube is used. The stacked tube parts are placed in suitable numbers on a plate of suitable material, and a number of these plates are placed, jointly, into a furnace. The furnace is pumped down to a vacuum of about 0.01 Pa at a temperature slightly below the melting point of the soldering material. Since the tube parts are stacked loosely, there will also be a vacuum in the internal spacing of the stacks. Subsequently, at the same temperature, refilling gas is fed into the furnace and thus also into the stacked tubes. The temperature is then raised, and thus, the tubes are soldered together within the gaseous atmosphere. As in the previous case, after cooling, an electrical stabilizing treatment is applied to the final test.

Also in the case of tubes manufactured according to the second method, it is sometimes desired to mix a small amount of tritium with the filling gas. However, since the gas in the furnace is, after cooling, ventilated after each pumping turn or cycle, it is inconceivable to mix tritium with the filling gas. Instead, a diffusion process, as disclosed in Swedish Pat. No. 375,201, is frequently used after the completed pumping process.

Variants of these two manufacturing methods are sometimes used, but the feature that all of them have in common is that they are rather cumbersome, require much energy and manufacturing equipment, and are not suited for automatic in-line production.

A more in-line oriented production method has been proposed in Swedish Patent Application No. 7,910,359-4. This manufacturing method is based, in part, on the property of the gases to equalize, through diffusion, any partial pressure differences within the limits of volume and, in part, on the varying capacity of the gases to penetrate, e.g. glass and ceramics, through diffusion, and in many cases also through effusion. This penetration varies considerably among the gases. The difference may be as high as several times the 10th power between a gas with a small molecular diameter and low density, e.g. hydrogen and helium, and a gas with a large molecular diameter and high density, e.g. argon, krypton, and xenon. For purposes of this invention, gas with a small molecular diameter and low density shall be designated as a light gas, whereas a gas with a large molecular diameter and high density shall be called a heavy gas.

The method signifies that the tube parts are stacked as in other manufacturing methods described above. No exhaust tubes are used. After the stacking, the tube stack is placed in a furnace with a gas mixture that is substantially at atmospheric pressure and consists of suitable light and heavy gas, e.g. hydrogen and argon. This gas mixture will envelop the tube and also enter it and replace the air therein. This occurs at a temperature that is gradually increased and, after a suitable time, will reach the sealing temperature. After the sealing, the temperature is lowered to slightly below the sealing temperature and the sealing gas is replaced by heavy gas only, e.g. argon, substantially at atmospheric pressure. Since the partial pressure of the hydrogen is now higher inside the tube than outside thereof, a portion of the hydrogen enclosed in the tube will, at the prevailing temperature, diffuse through the tube wall. The partial pressure of the argon is higher outside the tube than inside thereof, but argon cannot penetrate the tube wall to any significant extent. When the desired argon/hydrogen ratio and the total pressure in the tube has been reached, the diffusion is interrupted and the tube is cooled to a suitable temperature.

The process can of course be performed in a conventional stationary furnace with gas flow facilities and temperature control. But the method is also suited for in-line production. A belt-fed furnace with sections for heating/sealing, respectively diffusion and subsequent cooling can be used to perform the method. Since the entire process takes place mainly at atmospheric pressure, only simple partition walls with a passage opening for the conveyer belt and the tubes or plates with the tubes placed thereon are needed to adequately separate the various sections. As in the other above-described prior art methods, the cooling is followed by an electric stabilization treatment before final testing. Also in this case tritiation may be applied by means of tritium diffusion.

This method is simple and suited for in-line production. However, it makes special demands on the diffusion properties of the material used in the tube parts, if the diffusion time is to be kept within reasonable limits. In the present situation, this requires additional cost for the tube parts, as compared to the cost of using more conventional material.

SUMMARY OF THE INVENTION

According to the invention described below, while using conventional material for electrodes and ceramic tubes, it is possible to reduce the diffusion time to 1–2 hours. This is achieved in that, during the diffusion time, the tube is in a vacuum or is enveloped in the sealing gas or any other suitable gas, at a lower pressure than atmospheric pressure, e.g. a pressure which is about or lower than 3 kPa. However, it is desirable that the light gas originating from the sealing gas mixture and which may therefore remain to some extent after pressure reduction, has a partial pressure which is lower than the partial pressure of the light gas enclosed in the tube is intended to be at the end of the diffusion time.

The effect of the total pressure difference between the gases inside the tube and outside of it, as shown by normally utilized tube parts, seems in this case to indicate that the gas penetration through the tube walls depends not only on diffusion, but is caused also by effusion.

BRIEF DESCRIPTION OF THE DRAWINGS

The invention will be explained in greater detail in relation to FIG. 1 which shows a conventional embodiment of a two-electrode tube for transient purposes.

DETAILED DESCRIPTION OF THE DRAWINGS

Figure 1:
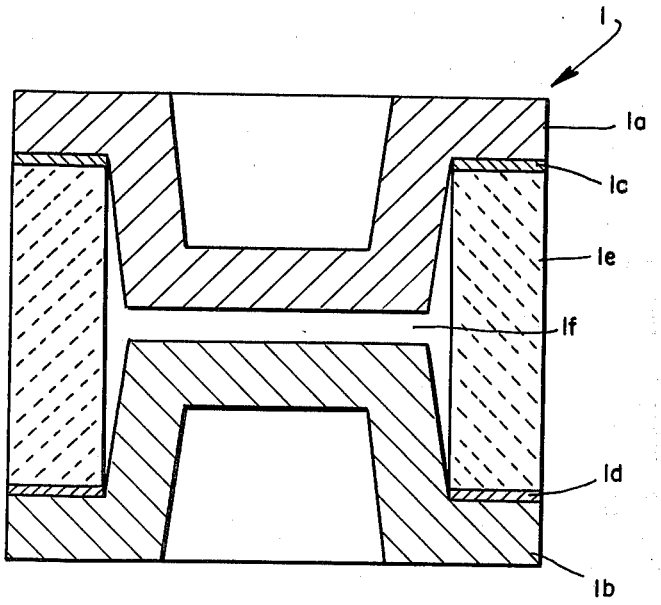

FIG. 1 shows how the tube 1 is fabricated from electrodes 1*a* and 1*b*, the solder rings 1*c* and 1*d*, and the ceramic tube 1*e* are stacked. The dimensions are selected in such a way that a gap 1*f* is formed between the electrodes 1*a* and 1*b*. The solder rings 1*c* and 1*d* can be designed in such a way that, prior to the melting of the solder, they are not too tight to the ceramic element and to the electrodes. This has a certain importance in that the tube 1, after stacking, is placed at approximately atmospheric pressure in a mixture of a suitable light and heavy gas, such as hydrogen and argon, which will envelop the tube and enter it, and replace the air present therein. This occurs suitably in connection with heating to a temperature slightly below the melting temperature of the soldering material. The soldering of the tube parts, and thus the sealing of the tube, is then brought about by raising the temperature until the solder melts. When the soldering material consists of a silver-copper eutectic, a soldering temperature of about 800° C. is customary. The temperature is subsequently lowered to a value slightly below the setting temperature of the solder and which, for the silver-copper eutectic, is the same as the melting temperature.

After sealing, the sealing gas is pumped out so that the gas pressure around the tube will drop below atmospheric presure, preferably to about 3 kPa or less. A simple vacuum pump can be used for this purpose, since there is only a modest vacuum requirement. This procedure, at the prevailing temperature, brings about a diffusion and effusion-based penetration of hydrogen out of the ceramic tube, and perhaps even through the electrodes, whereas there will hardly be any change in the argon content of the tube. The result is that the gas pressure inside the tube will drop to a value which depends on the original hydrogen and argon composition of the enclosed gas mixture, as well as on the properties, thickness, and area of the ceramic tube, and, further, on the temperature, outside gas pressure, and time.

It has been stated above that, when using argon with 10–15% hydrogen, a total gas pressure is often desired which, at room temperature, would be of the order of magnitude of 10–12 kPa. This means that the partial pressure or argon in a finished tube must be about 10 kPa. Since the amount of argon in the tube changes only insignificantly during the diffusion phase, the corresponding partial pressure at a sealing temperature of 800° C. will, according to the gas laws, be 36 kPa. For within an unchanged volume, the gas pressure is changed by a factor equal to the ratio between the Kelvin value of the temperature, in this case 1073° K. respectively 298° K., or a ratio of 3.6. The sealing is assumed to occur substantially at atmospheric pressure, i.e. at about 100 kPa. Consequently, hydrogen is added until the argon-hydrogen mixture reaches a total pressure of about 100 kPa.

With the subsequent diffusion, the hydrogen, as described above, exits through the walls of the sealed tube. This process is interrupted when the gas mixture in the tube has reached the correct mixture ratio and pressure. Any desired tritiating can now be done in the same manner as described above, namely through diffusion according to the Swedish Pat. No. 375,201.

A conventional furnace with an arrangement for the gas flow and equipment for moderate evacuation can very well be used for the application of the method. It will be obvious to the person skilled in the art that the method can also be used in connection with a belt-furnace with gate arrangements between the heating/sealing section and the suitably evacuated diffusion section, as well as between the latter and the cooling section.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. A method for manufacturing a gas-filled discharge tube, designed, e.g., as transient protector, containing tube components comprised of at least two electrodes and an insulating body holding the electrodes joined vacuum-tight, with the electrodes and the insulating body dimensioned and arranged in such a way that at least one discharge gap is present in the tube, comprising the steps of:

A. sealing at a suitable temperature the components of the tube at substantially atmospheric pressure in a light gas mixed with another gas which, in view of the intended function of the tube is desirable and heavier than the first-mentioned gas, and B. reducing the pressure exteriorally of said tube below atmospheric pressure so as to obtain a pressure lower than that pressure at sealing temperature, while simultaneously lowering the temperature to such extent that the heavy gas can only to an insignificant degree penetrate the tube walls through diffusion and/or effusion, whereas the enclosed light gas can diffuse and/or be effused through the walls such that, as a result of the partial or total pressure difference, it will migrate through the walls of the tube, thus causing a reduction in the total gas pressure inside the tube.

2. A method according to claim 1, wherein the light gas is hydrogen or helium or a mixture thereof, whereas the heavy gas is argon, krypton, or xenon or a mixture thereof.

3. A method according to claim 1, wherein the heavy gas entering the utilized gas mixture at the joining and sealing of the tube components forms such a large portion thereof that its partial pressure at the sealing corresponds, according to the gas laws, to the desired partial pressure at room temperature for this gas, whereas the light gas is added in such an amount that the total pressure of the gas mixture at the sealing temperature is approximately equal to atmospheric pressure.

4. A method according to claim 1, wherein the components of the tube are placed in a process chamber in which it successively is influenced by suitable temperatures and corresponding suitable gas-flow for the accomplishment of sealing, effusion and cooling.

5. A method according to claim 1, wherein the pressure exteriorally of the tube is brought down to about 3 kPa or less.

6. A method according to claim 1, and further including the step of maintaining said tube at said reduced pressure suitable temperature for a period of time necessary to reduce said total gas pressure to that desired.

* * * * *